United States Patent [19]

Ostroski et al.

[11] 4,389,780

[45] * Jun. 28, 1983

[54] BAG OPENING DEVICE FOR CAN OPENERS

[75] Inventors: Richard J. Ostroski, Jackson County, Mo.; James B. Aberer, Contra Costa County, Calif.; Gary Best, Jackson County, Mo.

[73] Assignee: Rival Manufacturing Company, Kansas City, Mo.

[ * ] Notice: The portion of the term of this patent subsequent to Nov. 30, 1999, has been disclaimed.

[21] Appl. No.: 154,785

[22] Filed: May 30, 1980

[51] Int. Cl.[3] ..... B21D 53/50

[52] U.S. Cl. ..... 30/408; 30/362

[58] Field of Search ..... 30/288, 362, 388, 408, 30/DIG. 3; 83/435, 500–503, 508

[56] References Cited

U.S. PATENT DOCUMENTS

| | | | |
|---|---|---|---|
| 2,679,098 | 5/1954 | Deicken | 30/DIG. 3 |
| 3,763,748 | 10/1973 | Gallagher, Jr. | 83/508 X |
| 3,942,247 | 3/1976 | Ponczek et al. | 30/408 |
| 3,982,455 | 9/1976 | Bowman | 83/435 X |
| 4,086,835 | 5/1978 | Frederick | 83/508 X |

FOREIGN PATENT DOCUMENTS

| | | | |
|---|---|---|---|
| 1396874 | 3/1964 | France | 30/DIG. 3 |

*Primary Examiner*—James G. Smith

*Attorney, Agent, or Firm*—Hume, Clement, Brinks, Willian & Olds, Ltd.

[57] ABSTRACT

A device for opening sealed food bags is mounted on the frame of an electric can opener. The device includes a serrated cutter wheel which is driven by the can opener motor. A guide surface on the frame guides the bag as it is being fed through the cutter wheel. A modified form of the invention includes a pair of idler discs which overlap the cutter wheel. In a third form of the invention, the cutter wheel is not driven, and a pivotal lever is used to maintain the bag against the cutter wheel as it is fed manually through the cutting mechanism.

4 Claims, 14 Drawing Figures

Fig. 1.
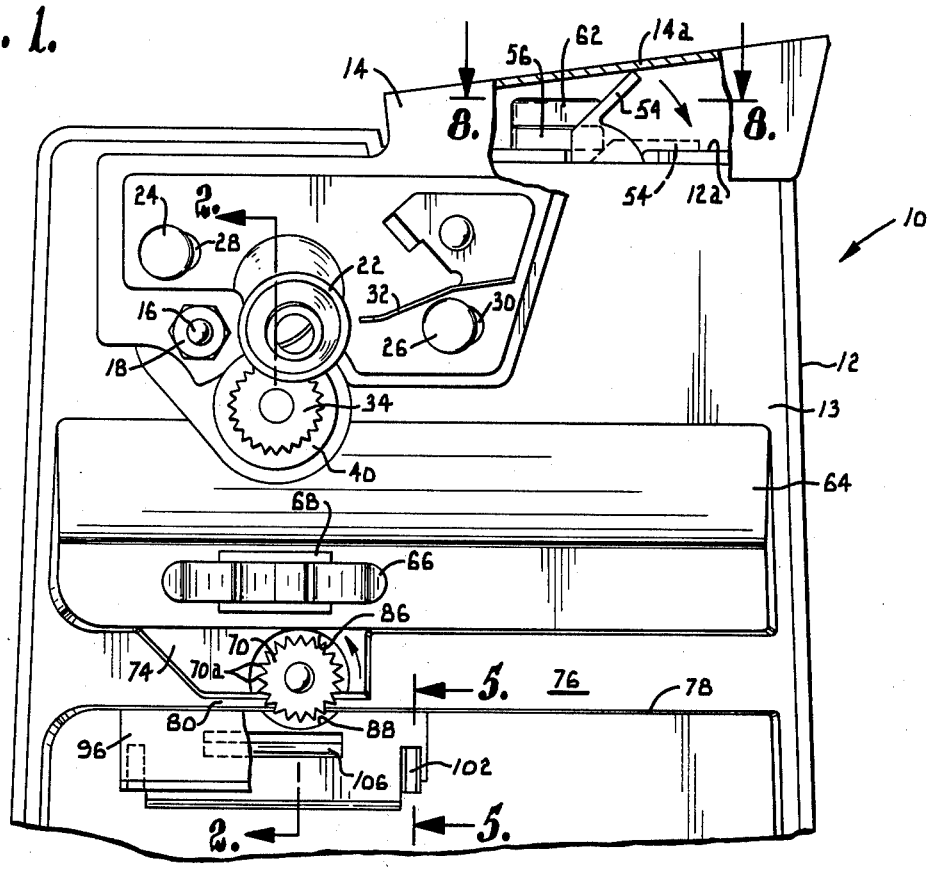
Fig. 2.
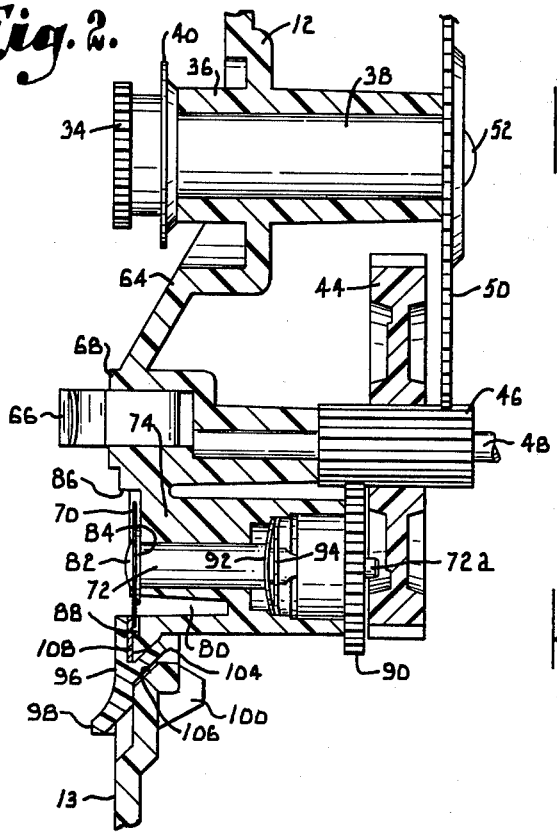
3.
3.
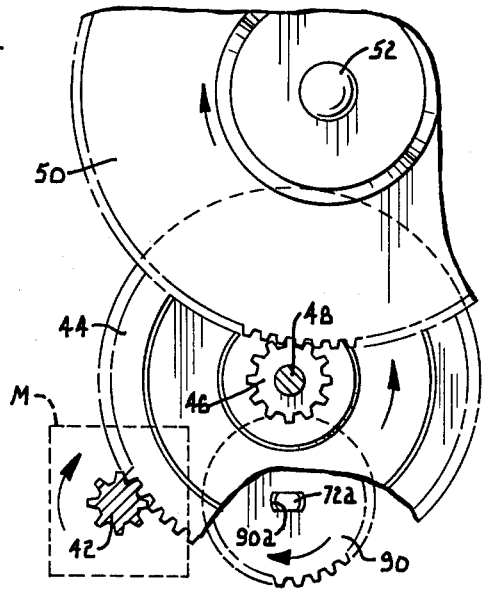
Fig. 3.

Fig. 4.
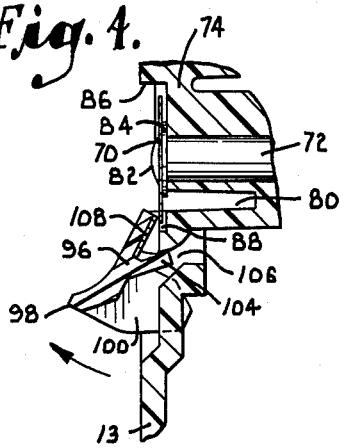
Fig. 5.
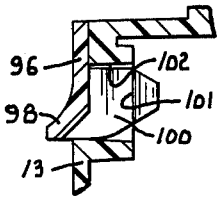
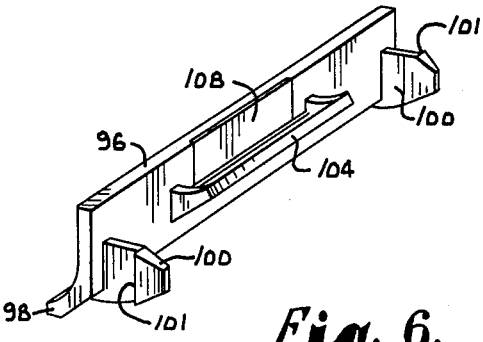
Fig. 6.
Fig. 7.
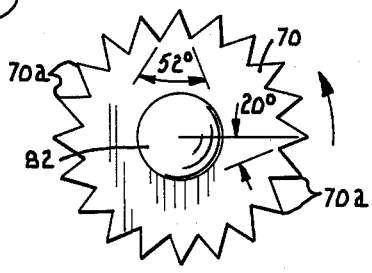
Fig. 8.
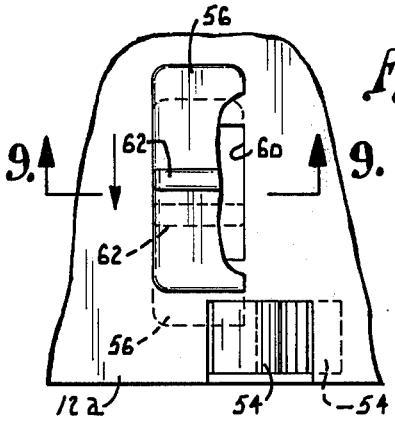
Fig. 9.
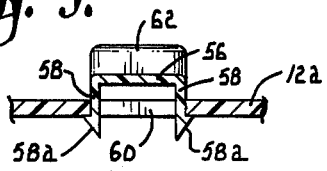
Fig. 10.
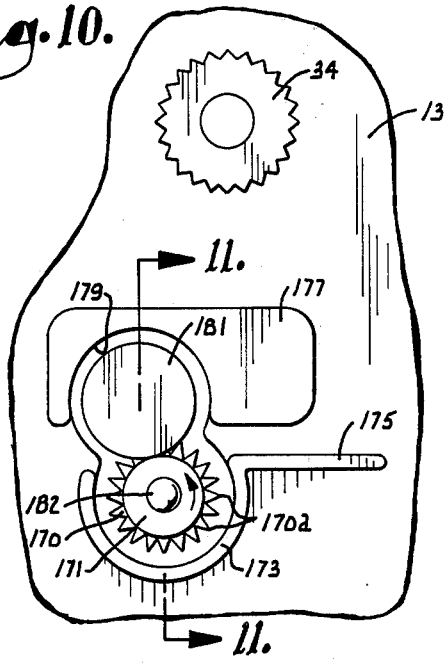
Fig. 11.
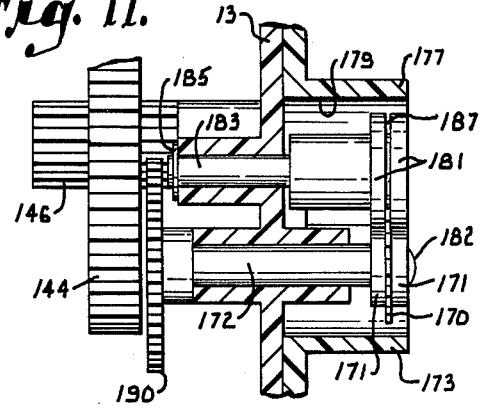

BAG OPENING DEVICE FOR CAN OPENERS

BACKGROUND AND SUMMARY OF THE INVENTION

This invention relates generally to a device for opening sealed bags and more particularly to a bag opening device which is combined with a power operated can opener.

A large number of food products are packaged in various types of sealed bags. Examples of such bags are the tough plastic bags known as retort pouches in which meats and frozen vegetables are packaged, the relatively thin plastic bags which commonly contain other types of foods, and the various metal and plastic lined bags which contain foods such as nuts. In order to effectively seal the contents and also to protect the food against pests and theft, the bags are often intentionally constructed in a manner to prevent them from being easily opened. Consequently, many types of bags are difficult if not impossible to tear open by hand and knives, scissors or other instruments must be used to open them. Even when such instruments are readily available, cutting or tearing of the bag at the desired location and in the proper manner is not always easily achieved. As a result, it is not uncommon for the contents of the bags to be spilled during attempts to open them.

It has therefore been found that a need exists for a household appliance which is specially constructed to quickly and easily open the various types of sealed bags and pouches in which food is packaged. It is the primary goal of the present invention to meet that need.

More specifically, it is the object of the invention to provide a bag opening device which is capable of opening a wide variety of food bags ranging from thin pliable plastic bags to thick metallic type bags.

Another object of the invention is to provide a bag opening device of the character described which is combined with a power operated can opener. Combining the two devices provides a single machine which may be employed to open virtually any type of food container. The combined machine takes up no more storage space than a standard electric can opener, and duplication of many costly components is avoided by combining the two devices in a single machine.

Still another object of the invention is to provide a bag opening device of the character described wherein the can opening and bag opening mechanisms are arranged in a manner to avoid interferring with one another.

A further object of the invention is to provide a bag opening device having a serrated cutter wheel which is constructed in a manner to readily penetrate and cut through a wide variety of materials having various thicknesses. The teeth of the cutter wheel are specially shaped such that they are able to completely shear or effectively perforate all of the bags which the machine is designed to handle, without jamming the cutter wheel or failing to properly penetrate the bag material.

Yet another object of the invention is to provide, in a bag opening device of the character described, a gear train which connects the drive motor of the machine with both the can feed wheel and the bag cutter wheel. This arrangement avoids the need to provide separate motors for the two mechanisms, and the overall cost is reduced accordingly.

An additional object of the invention is to provide, in a bag opening device of the character described, a latch member which maintains the drive motor energized during feeding of the bags through the cutting mechanism.

A still further object of the invention is to provide a bag opening device in which the bag is properly guided and held against the cutter wheel as it is feed through the cutting mechanism. As a result, the bag is opened along a straight line at the desired location.

Still another object of the invention is to provide a bag opening device which accepts only those bags which are thin enough to be cut properly by the cutter wheel. In this respect, the slot located adjacent to the cutter wheel is narrow enough that only bags which are within the requisite size range can be fed through the cutting mechanism. The cutter wheel thus encounters only the types of bags and pouches which the device can readily open, and thick containers and other articles that could possibly damage the mechanism are rejected.

Yet another object of the invention is to provide a bag opening device of the character described wherein the cutter wheel and associated retainer element may be quickly and easily removed from the frame for cleaning.

Another object of the invention is to provide a bag opening device which is simple and economical to construct and operate and which is readily adapted to be incorporated into virtually any type of power operated can opener.

An additional object of the invention is to provide a bag opening device of the character described which operates safely. The cutter wheel is effectively shielded so that it cannot be inadvertently contacted by the fingers.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 1 is a fragmentary front elevational view of a power operated can opener which is equipped with a bag opening device constructed according to a preferred embodiment of the present invention, with portions broken away for purposes of illustration;

FIG. 2 is a fragmentary sectional view on an enlarged scale taken generally along line 2—2 of FIG. 1 in the direction of the arrows;

FIG. 3 is a fragmentary rear elevational view of the gear train taken generally along line 3—3 in the direction of the arrows, with a portion of one gear broken away for purposes of illustration;

FIG. 4 is a fragmentary sectional view similar to the lower portion of FIG. 2, but showing the retainer element for the cutter wheel being removed from the can opener frame;

FIG. 5 is a fragmentary sectional view on an enlarged scale taken generally along line 5—5 of FIG. 1 in the direction of the arrows;

FIG. 6 is a perspective view of the retainer element which retains the cutter wheel in place on the frame;

FIG. 7 is an enlarged front elevational view of a preferred form of the cutter wheel;

FIG. 8 is a fragmentary top plan view of the switch actuator and latch mechanism taken generally along line 8—8 of FIG. 1 in the direction of the arrows, with the broken lines showing the switch actuator held in the depressed position by the latch mechanism;

FIG. 9 is a fragmentary sectional view taken generally along line 9—9 of FIG. 8 in the direction of the arrows;

FIG. 10 is a fragmentary front elevational view of a power operated can opener which is equipped with a bag opening device constructed according to a second embodiment of the invention;

FIG. 11 is a fragmentary sectional view taken generally along line 11—11 of FIG. 10 in the direction of the arrows;

DETAILED DESCRIPTION OF THE INVENTION

Figure 12:
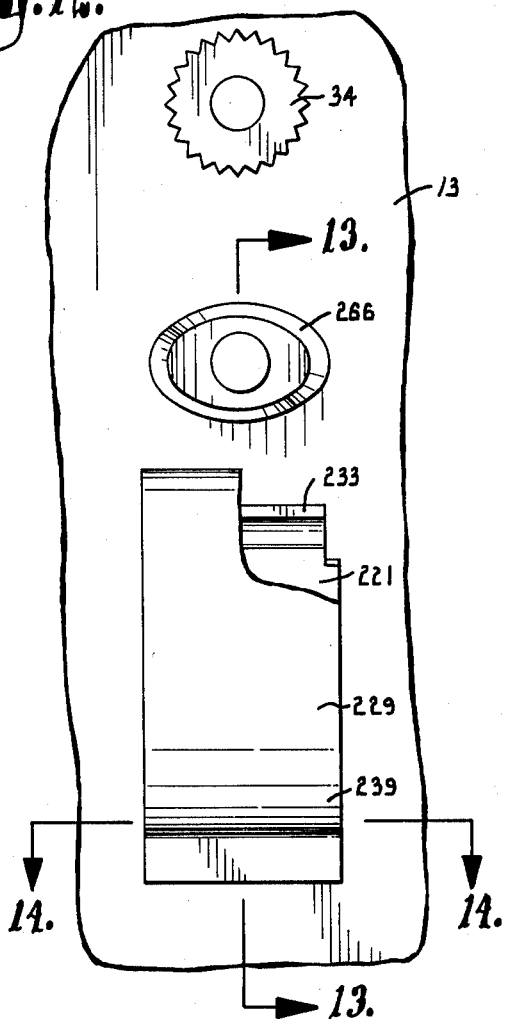
FIG. 12 is a fragmentary front elevational view of a power operated can opener which is equipped with a bag opening device constructed according to a third embodiment of the invention, with a portion broken away for purposes of illustration.

Referring now to the drawings in more detail and initially to FIG. 1, reference numeral 10 generally designates an electric can opener. The can opener 10 includes an upright frame or casing 12 having a front panel 13 which may be constructed of a rigid molded plastic. The operating components of the can opener are mounted on front panel 13 and housed within the casing 12.

The can opening mechanism may be of the same general type shown in U.S. Pat. No. 4,053,981. A hand lever 14 is mounted on the front surface of frame 12 for pivotal movement about a horizontal axis defined by a pin 16 which receives a nut 18. A cutter mounting plate 20 is mounted on the forward surface of lever 14 for lateral sliding movement thereon. Plate 20 carries a cutter wheel 22 which is mounted for limited wobble movement. Rivets 24 and 26 project forwardly from hand lever 14 through respective elipical openings 28 and 30 formed in cutter mounting plate 20, thereby permitting the plate to shift laterally on the lever. A resilient can guide 32 is carried on plate 20, while pin 16 serves as a fixed hand guide during operation of the can opener.

The can opening mechanism includes a serrated can feed wheel 34 which is mounted on a cylindrical boss 36 (FIG. 2) projecting from front panel 13. Can feed wheel 34 is carried on the forward end of a rotatable shaft 38 which extends through boss 36. A latch 40 is installed on shaft 38 and serves to hold hand lever 14 on the frame in the manner explained in U.S. Pat. No. 4,053,981.

With reference to FIGS. 2 and 3 in particular, the can feed wheel 34 is driven by a conventional electrical motor M having a drive shaft carrying a small pinion 42. The pinion 42 drives a large gear 44 which is carried on another pinion 46. Pinion 46 is mounted on a idler shaft 44 supported on the can opener frame. Pinion 46 mates with and drives a large gear 50 which is secured by a rivet 52 to the rearward end of shaft 38.

The electric motor M is normally maintained in the deenergized condition by the switch actuator 54 which is mounted on the top panel 12*a* of the can opener casing 12, as shown in FIG. 1. Switch actuator 54 is biased by a spring (not shown) toward the extended position thereof shown in FIG. 1, wherein motor M is maintained in a deenergized condition. When the switch actuator is depressed to the broken line position of FIG. 1, motor M is energized to effect driving rotation of pinion 42 and the can feed wheel 34. Lever 14 includes a rearwardly extending flange 14*a* which depresses switch actuator 54 when the hand lever is pivoted downwardly to carry cutter wheel 22 toward feed wheel 34 for opening of a can having its flange disposed on top of the feed wheel. When hand lever 14 is pivoted upwardly to move cutter wheel 22 away from feed wheel 34 for release of the can, flange 14*a* releases from switch acutator 54, and the actuator moves to the extended position wherein motor M is deenergized.

A latch 56 is mounted on top of panel 12*a* for sliding movement between the solid and broken line positions of FIG. 8. As shown in FIG. 9, latch 56 includes a pair of downwardly projecting legs 58 which extend through a slot 60 formed in the top frame panel 12*a*. Each leg 58 has an enlarged hook shaped lug 58*a* on its lower end which projects beneath the top frame panel. Flange 56 is thus mounted for sliding movement on top of panel 12*a* along the length of slot 60. A tab 62 projects upwardly from the center of latch 56 to facilitate sliding movement thereof with the fingers.

When latch 56 is slid to its forwardmost position, it overlies switch actuator 54 and engages a surface thereof to maintain the actuator in the depressed position. Latch 56 thus serves to maintain motor M in an energized condition even when hand lever 14 is released from the switch actuator. Latch 56 may be slid to the rear to the solid line position shown in FIG. 8 in order to release actuator 54, thereby deenergizing motor M.

With reference again to FIGS. 1 and 2, the front frame panel 13 includes an inclined portion 64 which inclines outwardly from top to bottom at a location below feed wheel 34. A can rest 66 is mounted at the lower end of inclined surface 64 on a small boss 68. Can rest 66 projects well forwardly of feed wheel 34 and serves to maintain the axis of a can inserted in the can opener at an outwardly inclined angle of at least 5 degrees from vertical. This maintains the can in proper position to be opened by cutter wheel 22 and also keeps the can away from the bag opening mechanism.

The bag opening mechanism includes a serrated or toothed cutter wheel 70 which is mounted on the forward end of a horizontal pin or shaft 72. Shaft 72 extends through a boss 74 which is located within a recess 76 (FIG. 1) formed in the front surface of frame panel 13. Boss 74 has a straight bottom surface which is spaced a selected distance above a flat horizontal guide surface 78 formed on frame 12 at the lower end of recess 76. A relatively narrow slot 80 is thus provided within recess 76 between guide surface 78 and the bottom surface of boss 74.

Cutter wheel 70 is mounted on shaft 72 by a rivet 82. A small washer 84 is fitted on shaft 70 between wheel 70 and the front surface of boss 74 in order to space the cutter wheel outwardly of the boss. Wheel 70 is located within an arcuate recess 86 formed in the front surface of boss 74. Wheel 70 extends across the front portion of slot 80, and its bottom edge portion is received in an arcuate recess 88 formed in the guide surface 78.

As best shown n FIGS. 2 and 3, the rearward end of shaft 72 is tapered at 72*a*, and the tapered portion 72*a* is flattened on opposite sides thereof. Tapered portion 72a extends through the body of a gear 90 which meshes with and is driven by pinion 46. The opening 90a through which the tapered portion 72a extends is flattened on opposite sides. Consequently, rotation of gear 90 rotates shaft 72 and the cutter wheel 70 carried thereon due to engagement of the flat sides of opening 90a against the flat sides of shaft portion 72a. Opening 90a is somewhat wider than the diameter of tapered shaft portion 72a such that shaft 72 has a loose fit with gear 90, thereby providing the cutter wheel 70 with sufficient play to accomodate variations and irregularities in the bags. Shaft 72 is biased forwardly by a curved spring washer 92 which acts against a stepped shoulder formed on shaft 72. The peripheral portion of spring washer 92 acts against a retainer 94 which is fixed to the can opener frame.

Cutter wheel 70 bears against a removable retainer 96 which retains the cutter wheel on the can opener frame. As best shown in FIG. 6, retainer 96 has a plate-like body with a forwardly turned lip 98 on its lower edge. A pair of lugs 100 project rearwardly from opposite ends of retainer 96 and are received in openings 102 (see FIGS. 1 and 5). Each lug 100 has a small shoulder 101 which engages the back surface of frame panel 13 to releasably hold retainer 96 on the frame. An inclined tap 104 projects upwardly and rearwardly from the back surface of retainer 96 and is received in a slot 106 formed in the front surface of frame 12. The back surface of retainer 96 is provided with a metal wear strip 108 which is glued or otherwise fixed within a cavity formed in the retainer. The bottom edge portion of cutter wheel 70 engages wear strip 108, as shown in FIG. 2.

Retainer 96 may be removed from the frame for cleaning by pulling lip 98 outwardly and slightly upwardly with the fingers in the direction indicated by the directional arrow in FIG. 4. This releases shoulders 101 from the can opener frame and pulls lugs 100 out of openings 102 and tab 104 out of slot 106. When retainer 96 is removed, cutter wheel 70 may be removed for cleaning simply by pulling it forwardly to remove it and shaft 72 from the frame. After the retainer and cutter wheel have been cleaned, they may be replaced on the frame of the can opener.

In operation, the bag opening mechanism acts to open bags containing various types of foods. Motor M is energized to rotate cutter wheel 70 by depressing switch actuator 54 and sliding latch 56 to the solid line position of FIG. 8 wherein the latch holds the switch actuator in the depressed position. The portion of the bag which is to be opened is placed on top of the horizontal guide surface 78 and is fed from left to right into slot 80 toward cutter wheel 70. When the cutter wheel engages the bag, its sharp peripheral teeth cut through the bag in a manner to either completely shear off the cut portion of the bag or to perforate it such that it can thereafter be easily torn open. Whether the bag is sheared or perforated depends upon its thickness and the material of which it is constructed. Guide surface 78 extends perpendicular to the rotatinal axis of wheel 70 and maintains the bag against wheel 70 to assure an effective and complete cut. Once the teeth of wheel 70 engage the bag, they assist in feeding it through the cutting mechanism, and the fingers are used only to maintain the bag in the proper position and to provide some assistance in feeding the bag through the cutter wheel. The cut or perforation line formed in the bag extends in a straight line.

Slot 80 is intentionally thin enough to prevent entry of containers which are too thick to be easily opened by the cutter wheel. In addition, articles which the machine is not designed to handle cannot fit through the relatively narrow slot 80, nor can the fingers. Retainer 96 overlaps the bottom edge portion of cutter wheel 70 to prevent the fingers of the user from inadvertently contacting the cutter wheel. When the bag opening operation has been completed, latch 56 may be slid to the solid line position of FIG. 8 in order to permit switch acutator 54 to move to the extended position for deenergization of the motor.

The can opening mechanism operates in the manner described in U.S. Pat. No. 4,053,981. The forwardly projecting can rest 66, in cooperation with the inclined surface 64, maintains the axis of the can at least 5° offset from vertical. The can is thereby located well outwardly of the bag opening mechanism, and the can opening and bag opening components do not interfere with one another.

With particular reference now to FIG. 7, the teeth 70a of cutter wheel 70 perferably have a special configuration in order to easily cut through the various types of bags in which foods are commonly packaged. There are preferably 20 teeth 70a with their crest or points spaced 18° apart from one another. The straight edges of each tooth meet at the point of the tooth at an angle of approximately 52°, with the trailing edge oriented at approximately 20° with respect to a radius line intersecting the point and the leading edge oriented at an angle of approximately 32° with respect to the radius line. It has been found that this tooth configuration results in optimum cutting action for a broad range of materials and thickness. (However, some angular modification can be made without departing from the scope of the invention.) For example, with tooth construction indicated above, even thin, pliable plastic bags are effectively cut and do not become caught in the cutter wheel to possibly jam the mechanism. Relatively thick and tough metallic bags are completely sheared off or perforated to an extent that they can be easily torn open. Pouches in which vegetable are packaged for boiling are completely perforated and may thereafter be torn open. Although the described tooth configuration is preferred since it effectively opens a broad range of bags, it is to be understood that alternative configurations may be provided and that a sharp cutting edge without teeth may be effectively open many types of bags. Cutter wheel 70 is preferably about 0.012 inch thick in order to make a fine cut through the bag without unduly tearing it.

FIGS. 10 and 11 illustrate a second embodiment of the bag opening device which is mounted on the front panel 13 of the can opener below the can feed wheel 34. The second embodiment of the bag opening device includes a cutter wheel 170 which is constructed in the same manner as wheel 70 and has a plurality of spaced apart teeth 170a which are identical to teeth 70a. Cutter wheel 170 maybe mounted on the forward end of a shaft 172 by a rivet 182 or cast as a one piece unit. The cutter wheel is sandwiched between a pair of smaller discs 171 carried on shaft 172. Shaft 172 is driven by a gear 190 which is driven by a pinion 146 corresponding to the pinion 46 described previously. Pinion 146 is turned by a large gear 144 corresponding to the gear 44 which is driven by the electric motor of the can opener.

Cutter wheel 170 is mounted in a recess formed on the front surface of frame 12 above an arcuate boss 173. A horizontal flange 175 connects with one edge of boss 173 and provides a flat, horizontal upper surface which serves as a guide surface for bags which are fed through the cutter wheel. Another boss 177 is formed on the front surface of panel 13 and provides an arcuate recess 179 which receives a guide wheel assembly.

The guide wheel assembly includes a pair of spaced apart wheels or discs 181 which are carried on the forward end portio of a horizontal idler shaft 183. Shaft 183 is located above and parallel to shaft 172 and is journaled for rotation to permit free rotation of discs 181. A washer 185 or a similar retaining element is employed to retain shaft 183 on the can opener frame. Discs 181 engage discs 171 in edge to edge contact and are spaced apart from one another to present an annular grove 187 between them. The peripheral teeth 170*a* of cutter wheel 170 are closely received within groove 187.

The embodiment of the invention shown in FIGS. 10 and 11 operates to open sealed food bags in substantially the same manner as the first embodiment of the invention. The portion of the bag which is to be openend is placed on top of the flat guide surface of flange 170 and is fed from right to left into the cutting mechanism between wheel 170 and discs 181. Teeth 170*a* shear off or perforate the bag as it is fed through the cutter wheel, and discs 181 act to maintain the bag against the teeth of the cutter wheel. Discs 181 are able to rotate freely and thus facilitate the feeding of the bag through the cutting mechanism. The outer disc 181 overlaps the sharp teeth of cutter wheel 170 in order to shield the teeth from the fingers.

The narrow slot persented between flange 175 and boss 177 prevents the entry of containers and other articles which could possibly damage the cutting mechanism. Although cutting wheel 170 is preferably driven by the electric motor M of the can opener, it is possible in some instances simply to feed the bag through the cutting mechanism by hand and without driving the cutter wheel. Wheel 170 can thus simply be mounted on the frame for free rotation.

Figure 13:
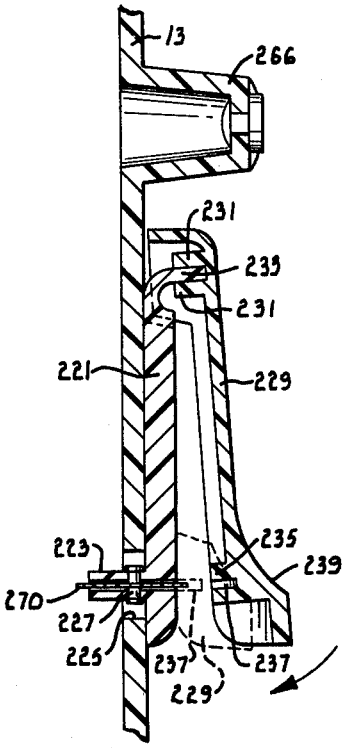
FIG. 13 is a fragmentary sectional view taken generally along line 13—13 of FIG. 12 in the direction of the arrows.
Figure 14:
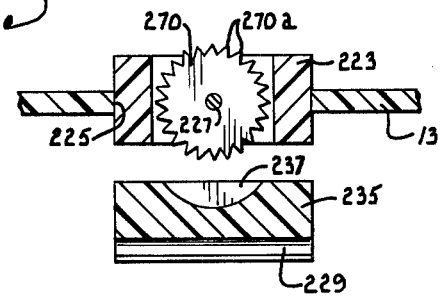
FIG. 14 is a fragmentary sectional view taken generally along lne 14—14 of FIG. 12 in the direction of the arrows.

Referring now to FIGS. 12–14, a third embodiment of the invention includes a cutter wheel 270 which is not a driven wheel but is instead freely rotatable. Cutter wheel 270 is mounted on the front panel 13 of a can opener having the can feed wheel 34. Replacing can rest 66 is a modified can rest 266 in the form of a boss projecting forwardly from the front surface of panel 13.

Cutter wheel 270 is constructed in substantially the same manner as cutter wheel 70 and includes a plurality of peripheral teeth 270*a* to teeth 70*a*. The mounting assembly for wheel 270 includes a base plate 221 which is mounted to the front surface of frame panel 13 in any suitable manner. A mounting arm 233 projects rearwardly from the lower portion of base plate 221 through a slot 225 formed in the front frame panel 13. Cutter wheel 270 is mounted to arm 223 for free roation about a vertical pin 227. Cutter wheel 270 is located within a recess formed centrally in arm 223 and has its edge portion projecting out of the recess forwardly of the front surface of plate 221, as shown in FIGS. 13 and 14.

A lever arm 229 is attached to base plate 221 for pivotal movement toward and away from cutter wheel 270. The upper end of lever 229 includes a pair of spaced apart flanges 231 which receive a flange 223 projecting forwardly from the upper end of plate 221. Flange 233 is received closely between flanges 231 in order to attach lever arm 229 to base plate 221 for pivotal movement between the positions shown in solid lines and broken lines in FIG. 13. Lever arm 229 may be easily removed from plate 221 for cleaning and other purposes.

The lower end portion of lever 229 has on its inside surface a boss 235 having a flat surface which mates with the flat surface of plate 221 adjacent the projecting edge of cutter wheel 270. A curved recess 237 is formed in boss 235 and has a size and shape to receive the projecting teeth 270*a* of cutter wheel 270 when lever arm 229 is presses inwardly to the cutting position shown in broken lines in FIG. 13. The outer side of arm 229 has a curved surface 239 on its lower portion to facilitate pushing of lever arm inwardly with the thumb or fingers.

In use of the bag opening device shown in FIGS. 12–14, the leading edge of the bag which is to be opened is inserted between base plate 221 and leaver arm 229, and the lever arm is then pressed inwardly toward cutter wheel 270 to engage the bag against the cutter wheel. With lever arm 229 held in the broken line position of FIG. 13, the bag is pulled through the cutting mechanism, with the teeth of the rotating cutter wheel 270 cutting through the bag to either shear it open or perforate it sufficiently to permit it to be easily torn open. Lever arm 229 provides a guard which prevents the fingers from contacting cutter wheel 270. Preferably, the space between plate 221 and arm 229 is narrow enough to prevent the entry of objects which are so large that they could possibly damage the cutter wheel.

From the foregoing, it will be seen that this invention is one well adapted to attain all the ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since may possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a power operated can opener having an upright frame, a can feed wheel rotatively mounted on said frame, a hand lever, a cutting element mounted on said lever, means mounting said hand lever on the frame for movement to carry the cutting element toward and away from the can feed wheel, and power means for effecting rotation of said feed wheel, the combination therewith of:

a bag cutter wheel mounted for rotation on said frame at a location offset from the can feed wheel, said cutter wheel having a peripheral edge formed to cut through a sealed bag containing food when the bag is fed past the cutter wheel in operating cutting proximity therewith;

guide means on the frame adjacent said peripheral edge for guiding the bag as same is being fed past the cutter wheel; and a retainer element removably mounted on said frame at a location to partially overlap the peripheral edge of said cutter wheel.

2. The invention set forth in claim 1, including a metal wear strip on said retainer element adjacent said cutter wheel.

3. In a power operated can opener having an upright frame, a can feed wheel rotatively mounted on said frame, a hand lever, a cutting element mounted on said lever, means mounting said hand lever on the frame for movement to carry the cutting element toward and away from the can feed wheel, and power means for effecting rotation of said feed wheel, the combination therewith of:

a bag cutter wheel mounted for rotation on said frame, in a manner permitting removal of the cutter wheel from the frame, at a location offset from the can feed wheel, said cutter wheel having a peripheral edge formed to cut through a sealed bag containing food when the bag is fed past the cutter wheel in operating cutting proximity therewith;

guide means on the frame adjacent said peripheral edge for guiding the bag as same is being fed past the cutter wheel; and a retainer element removably mounted on said frame at a location to overlap said cutter wheel in a manner to normally retain the cutter wheel on said frame.

4. The invention set forth in claim 3, including means urging said cutter wheel toward said retainer element.

* * * * *